US007458919B2

(12) United States Patent
Giusti

(10) Patent No.: US 7,458,919 B2
(45) Date of Patent: Dec. 2, 2008

(54) MULTI-STATION BOXING CENTER

(75) Inventor: Angelo Giusti, New York, NY (US)

(73) Assignee: Everlast Worldwide, Inc., New York, NY (US)

( * ) Notice: Subject to any disclaimer, the term of this patent is extended or adjusted under 35 U.S.C. 154(b) by 376 days.

(21) Appl. No.: 11/034,298

(22) Filed: Jan. 12, 2005

(65) Prior Publication Data

US 2005/0164847 A1 Jul. 28, 2005

Related U.S. Application Data

(60) Provisional application No. 60/536,033, filed on Jan. 12, 2004.

(51) Int. Cl.
*A63B 69/22* (2006.01)

(52) U.S. Cl. ..... 482/87

(58) Field of Classification Search ..... 482/83–90
See application file for complete search history.

(56) References Cited

U.S. PATENT DOCUMENTS 4,557,478 A * 12/1985 Levine ..... 482/89
5,863,278 A * 1/1999 Chen ..... 482/83
5,902,197 A * 5/1999 Davis et al. ..... 473/479
6,348,028 B1 * 2/2002 Cragg ..... 482/148

* cited by examiner

*Primary Examiner*—Fenn C Mathew
(74) *Attorney, Agent, or Firm*—Lackenbach Siegel LLP; Myron Greenspan

(57) ABSTRACT

A multi-station boxing center is provided. The multi-station boxing center has a base arranged to be positioned on a generally horizontal support surface and a canted frame having a means for supporting a heavy bag and a means for supporting a speedbag. The multi-station boxing center frame is positioned at an angle with said horizontal support surface such that the effective center of gravity of the boxing center prevents tipping of said boxing center. The multi-station boxing center base is disposed so as to prevent interference with the movement of a user.

10 Claims, 7 Drawing Sheets

MULTI-STATION BOXING CENTER

RELATED APPLICATION

This application claims priority from U.S. Provisional Patent Application Ser. No. 60/536,033, filed on Jan. 12, 2004.

FIELD OF THE INVENTION

The present invention generally relates to exercise devices and, more particularly, to a multi-station boxing center.

DESCRIPTION OF THE PRIOR ART

Numerous prior art patents illustrate a multi-device exercise center. These typically include a heavy bag and a speed bag. While some of the prior art constructions are more elaborate and probably more costly. U.S. Pat. No. 5,725,458 to Newman et al. illustrates a three-bag workout apparatus in which a central pole is mounted on a stand or base that is secured to the floor or mounting surface by means of screws. A speed bag is mounted on the pole in one plane, while a heavy bag is mounted on a slightly inclined extension pole in a plane laterally offset degrees from the plane in which the speed bag is mounted. An additional punching bag is also provided that is secured between a bar and bolt secured to the base.

The patentee also states that the equipment is intended to be used in any "home, garage, backyard, or buildings with a concrete floor." Thus, the base is intended to be secured to a cement or outdoor concrete patio area, although it is also contemplated that it can be moved without creating much damage to the device. Thus, while "transplantable" from one area to another, the apparatus is intended to be bolted to the surface at any given location. The reason appears to be that, with the construction used, the center of gravity, with the heavy bag mounted, is such that the entire device would topple except for the bolts that secure the base to the concrete surface.

U.S. Pat. No. 5,863,278 to Chen discloses a support frame that includes an upright rod on which a sandbag is mounted by means of a suspension rod, while the speed bag is mounted on the reverse side, as shown. Because the frame itself is relatively lightweight, three upright bars are provided to allow suitable weights to be secured to the base frame members to assure the stability of the unit during use.

U.S. Pat. No. 6,220,992 to Shafik illustrates another example of a prior art boxing exercise apparatus formed of a frame that is adjustable in a number of different ways to support different types of punching bags, including a heavy bag and a speed bag, as shown. This patent does not disclose a heavy base to stabilize the unit, nor does it appear to be secured to the floor or surface on which it is positioned. However, it is disclosed that the frame is secured to uprights, a conventional treadmill, which is not shown in the figures.

Prior art design patent D362,477 to Bluestein is of some interest because it shows a combined exercise step and punching bag stand, in which the base appears to be in the form of a molded hollow structure that could be filled with water or sand. The prior art design patent D335,513 to Gaetano also appears to be relevant and is smaller, in some respects, than the Chen '278 patent, although it does not indicate any means for weighing the frame down. Instead, it appears that the frame itself is stabilized on the floor against toppling or sliding by means of a platform attached to the base of the frame on which the user stands. Presumably, the weight of the user creates sufficient friction on the plate adequate to prevent movements of the frame itself.

Other prior art patents disclose a multi-device boxing centers utilizing some or all of the bags that can be used with the present invention. However, these patents do not appear to discuss the option in which there is an indoor/outdoor mobile device that includes a heavy bag permanently supported on the frame, while a plurality of other bags can interchangeably be used one at a time.

In particular, the feature of a heavy movable base, with a canted bar that supports the frame for the bags, is not found in the prior art. The closest prior art apparatus does have a plurality of training devices for boxers, but these are mounted on a form of frame that rests or is temporarily mounted to the floor.

The prior art fails to teach the use of a multi-station boxing center that is supported on a heavy base that can be filled with water or sand, or on a base that has wheels.

SUMMARY OF THE INVENTION

Therefore, it is primary objective of the present invention to provide an improved multi-station boxing center that is devoid of the shortcomings of the prior art boxing centers as represented by the above-identified prior art. More specifically, the multi-station boxing center in accordance with the present invention has the following benefits and/or advantages:

(1) It allows the user to exercise using a wide range of boxing devices customarily employed while training. This includes a "heavy" punching bag, a "light" punching bag or speed bag and such other devices as a kick bag and the like.

(2) In the present invention, these boxing devices are mounted so that they can be struck by the user in a normal upright position. The bags are suspended from a frame or from arms attached to the frame in such a way that the base does not occupy space used by a user during normal use.

(3) The frame of the present invention is supported by a base. The base is heavy to assure stability, but it is not attached to the floor. The base is in the form of a molded enclosure that can be filled with water or sand. The entire apparatus can be transported, and can be used either indoors or outdoors.

According to the present invention, it is contemplated that the heavy bag is permanently attached on a bar of a frame inclined at an angle of approximately 70 degrees with the base or the surface on which the base is supported. The materials used for the entire station are water- and weather-resistant so that they can withstand rain and other outdoor conditions. These materials include the use of rubber in the heavy bag to resist mildew and the like. While only one boxing device can be attached in addition to the heavy bag, such boxing device can be easily replaced and interchanged with a plurality of other boxing devices, as stated above.

Thus, while in the present invention the entire device can be relatively heavy, so that it is stabilized on the support surface, it can nevertheless be selectively moved from one location to another, either indoors or outdoors.

With the present invention, it is also possible that one or more sets of wheels can be constructed so that they can either be raised or lowered. In this way the base may be secured on the ground during use or raised above the ground and rolled on the wheels.

BRIEF DESCRIPTION OF THE DRAWINGS

The above and other objects of the invention may be more readily seen when viewed in conjunction with the accompanying drawings, wherein.

DETAILED DESCRIPTION OF THE PREFERRED EMBODIMENTS

Figure 1:
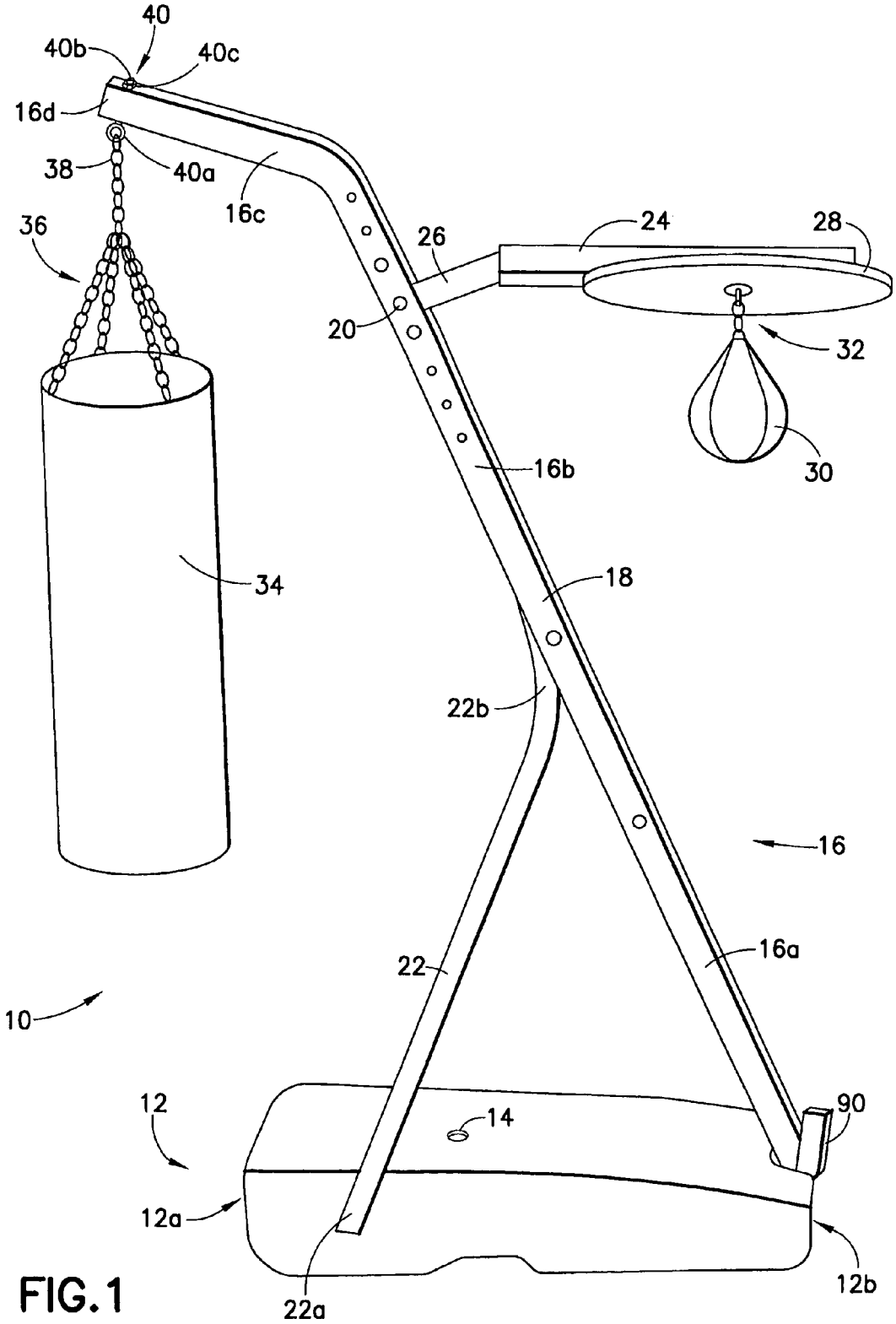
FIG. 1 is a side elevational view of a multi-station boxing center in accordance with the present invention, shown with a heavy kick bag and a speed bag mounted on opposite sides of the frame.

Referring now specifically to the drawings, in which identical or similar parts are designated by the same reference numerals throughout, and first referring to FIG. 1, the multi-station boxing center in accordance with the present invention is generally designated by the reference numeral 10.

The boxing center 10 includes a base generally designated by the reference numeral 12 that can be made of any material that will weigh the base down and make it sufficiently heavy so that the device will not slide on the surface on which it rests. Therefore, it will be evident that the base can be made from a wide range of different materials. However, in a presently preferred embodiment, the base is blow molded from a plastic material to provide a hollow interior that can be filled with substances that will render the base heavy when filled, such as water or sand. For this purpose, a plug or other access port 14 may be provided that can be removed to fill the base 12 with water, sand or the like and then closed. Plastic is particularly desirable for the base if the unit is to be used both indoors and outdoors, because of plastic's resistance to rust and weather conditions.

The base 12 is preferably generally flat, as shown, as has a relatively low profile. The actual cross sectional configuration of the base, taken along a plane parallel to the surface on which it rests, is not critical for purposes of the present invention. However, in the embodiments illustrated herein, the base is generally in the form of a trapezoid, having a wide end 12*a* and a narrow end 12*b*. An inclined primary support member 16 has a lower end 16*a* connected to the narrow end 12*b*, and an extension 16*b* levels at the upper end 16*c*, which forms a support portion, the free end of which is 16*d*.

Suitable couplings 18, 20 are provided for connecting the sections 16*a*, 16*b* and 16*c*, each of which is made smaller for purposes of shipment and storage.

In the presently preferred embodiment, the sections 16*a*, 16*b* and 16*c* are in the form of a square or rectangular tubes that have square or rectangular cross sections, respectively. These are hollow inside and may be extruded members. In this way, the primary support member 16 can be relatively strong and rigid while being relatively light in weight.

As indicated in FIG. 1, the primary support member 16 is inclined so that the lower end thereof is connected to the narrow end 12*b*, while the free end 16*d* extends or projects beyond the footprint of the base 12, assuming an angle as shown. The specific angle is not critical, although the more inclined from the vertical position, the more support will be required to maintain the member 16 from toppling. On the other hand, less inclination from the vertical may require a longer support member 16 to position the heavy punching or kicking bag beyond the footprint of the base. Therefore, the angle of the primary support member 16, as shown in FIG. 1, with minor variations, is suitable for the purpose intended.

In order to support the primary support member 16 in the position shown, any assemblage of members, such as beams, forming a rigid framework may be used. In the embodiments shown, a pair of trusses 22 are provided, each of which has a lower end 22*a* connected to one side of the wide end of the base 12*a* and an upper end 22*b* that is connected to the support member 16, in the region of the coupling member 18 in FIG. 1. Again, the specific location at which the trusses 22 are connected to the support member 16 is not critical, as long as such trusses adequately support, strengthen and stiffen the resulting rigid framework and prevent the primary support member from excessive movements both laterally as well as forwardly, rearwardly or in any other directions.

The upper end 16*b* of the support member 16 is preferably provided with a plurality of transverse holes 20 through which suitable means, such as pins, bolts or other fasteners, can extend to selectively secure a generally horizontal beam 24 at a desired height of a mounting portion 26. The horizontal beam 24 supports a horizontal support platform or rebound wall 28, in any conventional manner. The wall 28 itself supports a speed punching bag 30 by means of conventional pivot assembly 32. The speed ball or punching bag 30 is preferably positioned so that it is substantially directly over or slightly beyond the edge of the narrow end 12*b*. As suggested, the free end 16*d* is used for supporting a heavy bag or kick bag 34 by means of conventional chains 36, the upper end of which is provided with suitable coupling link 38 that can be secured to an eye-bolt assembly 40 having an eye 40*a* through which the coupling link 38 can engage. The eye-bolt itself extends through a suitable hole in the free end 16 and is secured in place by means of a nut 40*c* or the like.

The length of the support member 16, as well as its angle of inclination from the vertical direction, must be selected such that the center of gravity acting through the heavy bag or kick bag 34 can be adequately compensated for by the center of gravity of the heavy base. Thus, the base size and weight must be selected to not only overcome the tendency of the device to topple, in a counterclockwise direction, as viewed in FIG. 1, but also to be sufficiently steady on a support surface, such as a wooden or concrete floor, against static and/or sliding friction. In this way, even though significant horizontal forces are applied to the bags 30, 34, the bag will remain substantially fixed in place, except as to be more fully described. The mechanical aspects and the selection of the specific angles of inclinations and dimensions of length, as well as the relative weights of the kick bag or heavy bag 34 in relation to the weight of the base, will be readily ascertainable by those skilled in the art.

Figure 2:
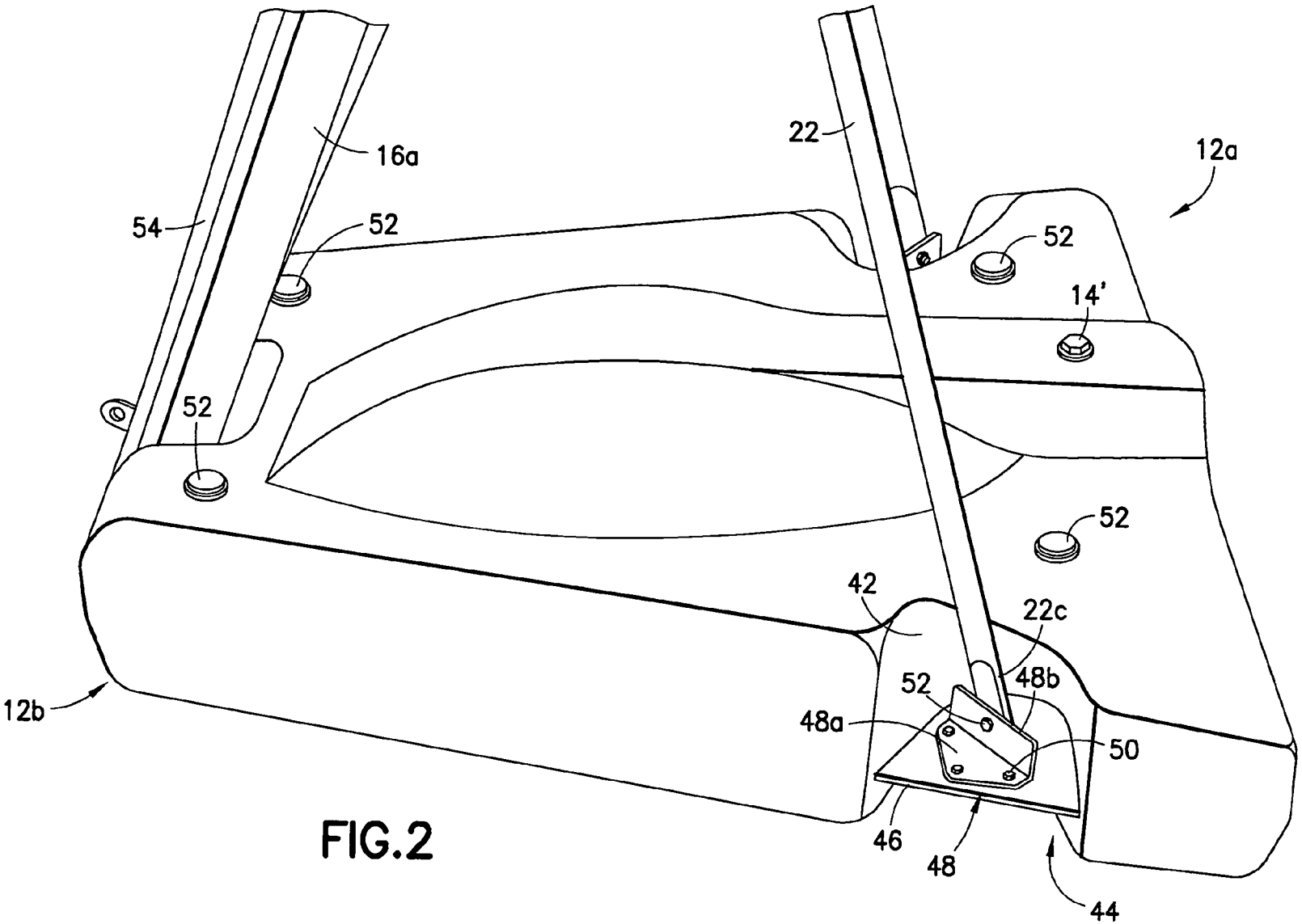
FIG. 2 is a perspective view of an alternate embodiment of a base for the multi-station boxing center shown in FIG. 1, showing the details of attachment of supporting trusses to the base.
Figure 3:
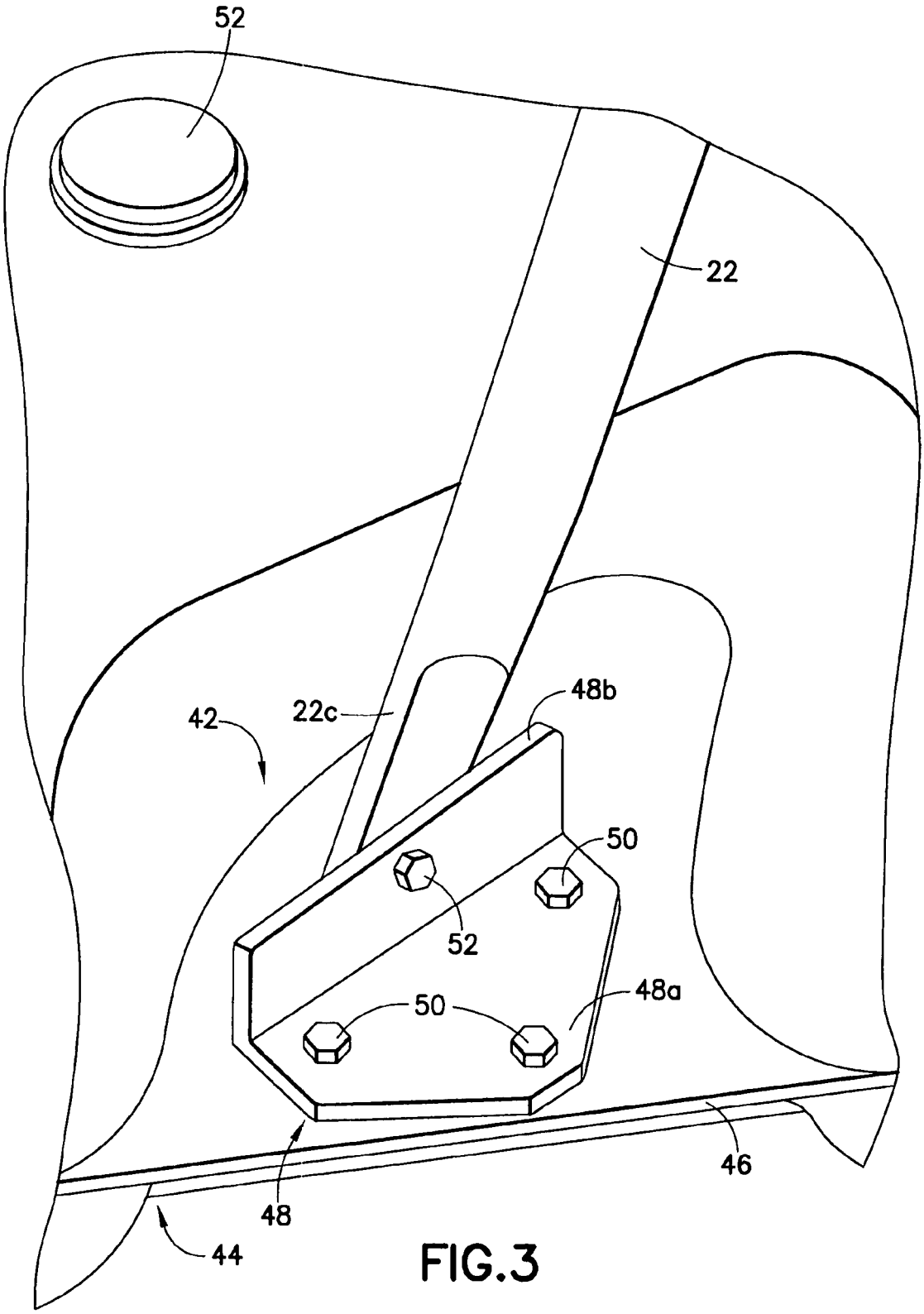
FIG. 3 is an enlarged detail showing the manner of connection of the lower end of each truss to a web formed on the base by means of an angle bracket.

A method of connecting the trusses 22 to the base is shown in FIGS. 2 and 3. Thus, there is preferably provided an upper recess 42 and a lower recess 44 on each side of the wide end 12*a* of the base to create a wall or web 46 that is generally flat and adapted to support an angle bracket 48 having a first generally horizontal attachment portion 48*a* that can be suitably connected to the web or wall 46 by means of suitably fasteners, such as bolts, rivets 50 or the like, and a second vertically extending attachment portion 48*b* suitable for attachment to a lower, flattened end 22*c* of the trusses 22. The method of connection of the flattened 22*c* to the second attachment portion 48*b* is not critical, although similar or different attachment mechanisms or fasteners may be used, such as bolts, rivets 52 or the like.

Also illustrated in FIG. 2 are the heads of bolts or rivets 52 that are provided on each lateral side of the wide end 12*a* and the narrow end 12*b*, which fasteners are used connect the base to wheel assemblies, to be more fully discussed below. Also shown in FIG. 2 is an opening or plug 14' that provides access to the interior of the hollow blow molded case so that such base can be filled, once in place, with water, sand or the like.

Figure 4:
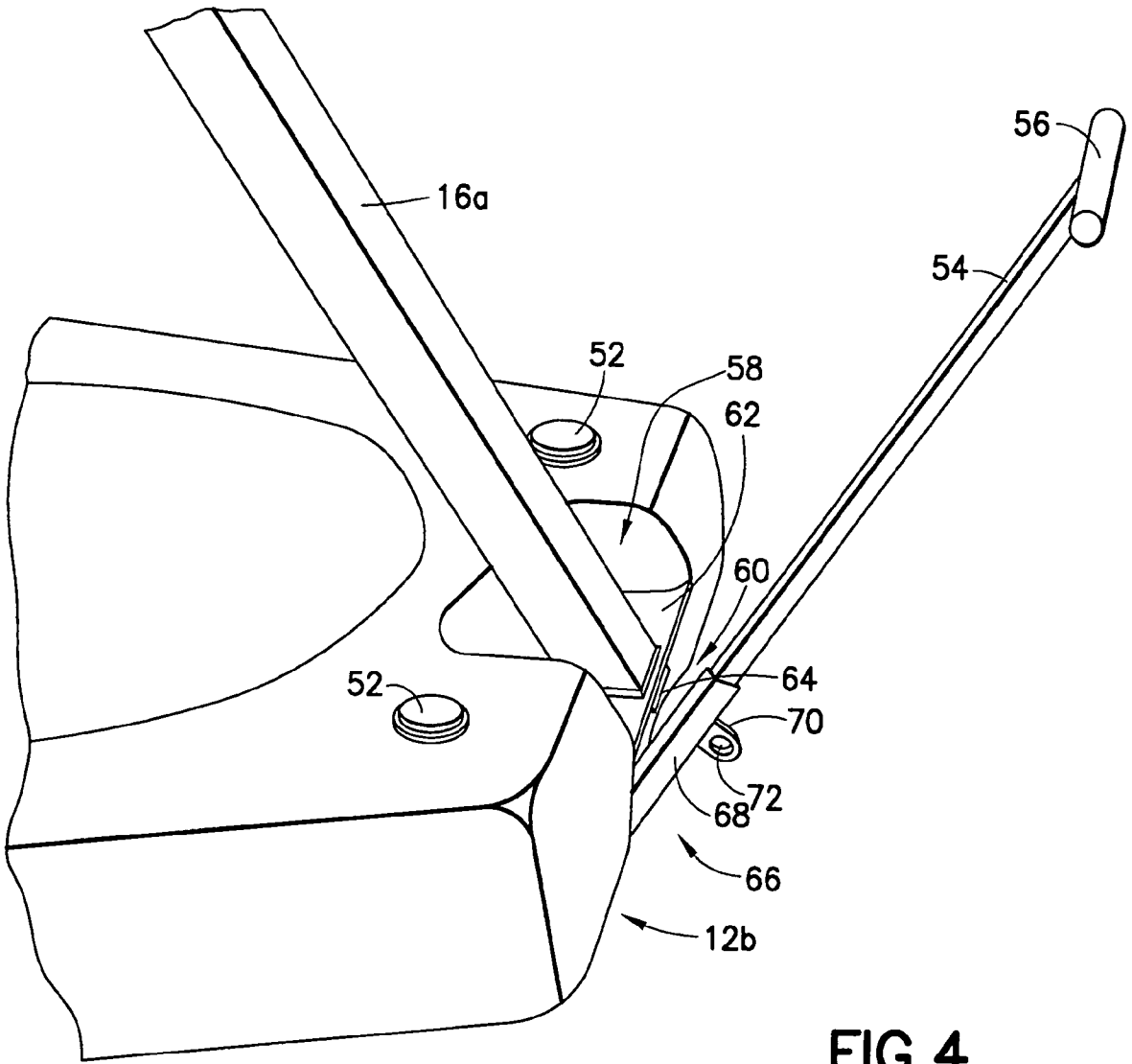
FIG. 4 is a perspective view of one end of the base showing the details of connection of the primary support member to the base and to a wheel assembly and handle.

Referring to FIG. 4, the narrow end 12*b* of the base is also shown to be provided with an elongate handle 54 provided with a transverse gripping crossbar 56 at the upper end, as shown. In proximity to the handle, there is an upper recess 58 in the upper side of the base and a lower recess 60 in the lower side of the base, at the narrow end 12*b*, to provide a generally flat wall or web 62, similar to the webs 46 previously discussed, to which the support portion 16*a* can be suitably fastened in any conventional way. However, the lower end of the handle 54 is preferably connected to a platform mounted on one or more wheels or rollers beneath the wall or web 62 so that the wheels can be selectively raised or lowered by any suitable and conventional lever means such as by the movement of the handle 54 to the position shown. Thus, for example, the wheel or wheels below the narrow end 12*b* are preferably in the raised position when the handle 54 is in the retracted condition as shown in FIG. 2. In such retracted position and raised position of the wheels or rollers, the base rests on the support surface, and sufficient static and sliding friction is provided to maintain the base fixed in position during use. However, when the handle 54 is pivoted to the position shown by means of a pivot at 68 on the wheel assembly 66, the wheels or rollers are lowered to effectively raise the narrow end of the base 12*b*. It will be clear to those skilled in the art that the level that the base end 12*b* must be raised to eliminate static and sliding friction is extremely small—on the order of millimeters or fractions of an inch. The extent to which the base must be raised at the end 12*b* will, to some extent, depend on the smoothness of the surface on which it rests, the flexibility of the wheels and rigidity or stiffness of the axles on which the wheels are mounted. The smoother the surface, the less it has to be raised to eliminate static and sliding friction. Also, to reduce the amount that the base has to be raised to roll it the wheels may be made from high polymer rubber or strong plastic, high load-bearing wheels to reduce deformation of the wheels when the base is raised and the load is assumed by the wheels.

The specific wheel assembly and lever action used at 66 is not critical, and any conventional lever assembly can be used that will raise the wheels the requisite or desired amount.

The lower end of the handle 54 is also shown provided with a tab 70 substantially vertically aligned with the pivot assembly 32 that has a hole 72 that can be used to lock the handle in place and/or to secure to a suitable device for towing or pulling the boxing center 10 or attaching to a punching bag supported by upper and lower flexible lines as shown in U.S. Pat. No. 5,725,458.

Figure 5:
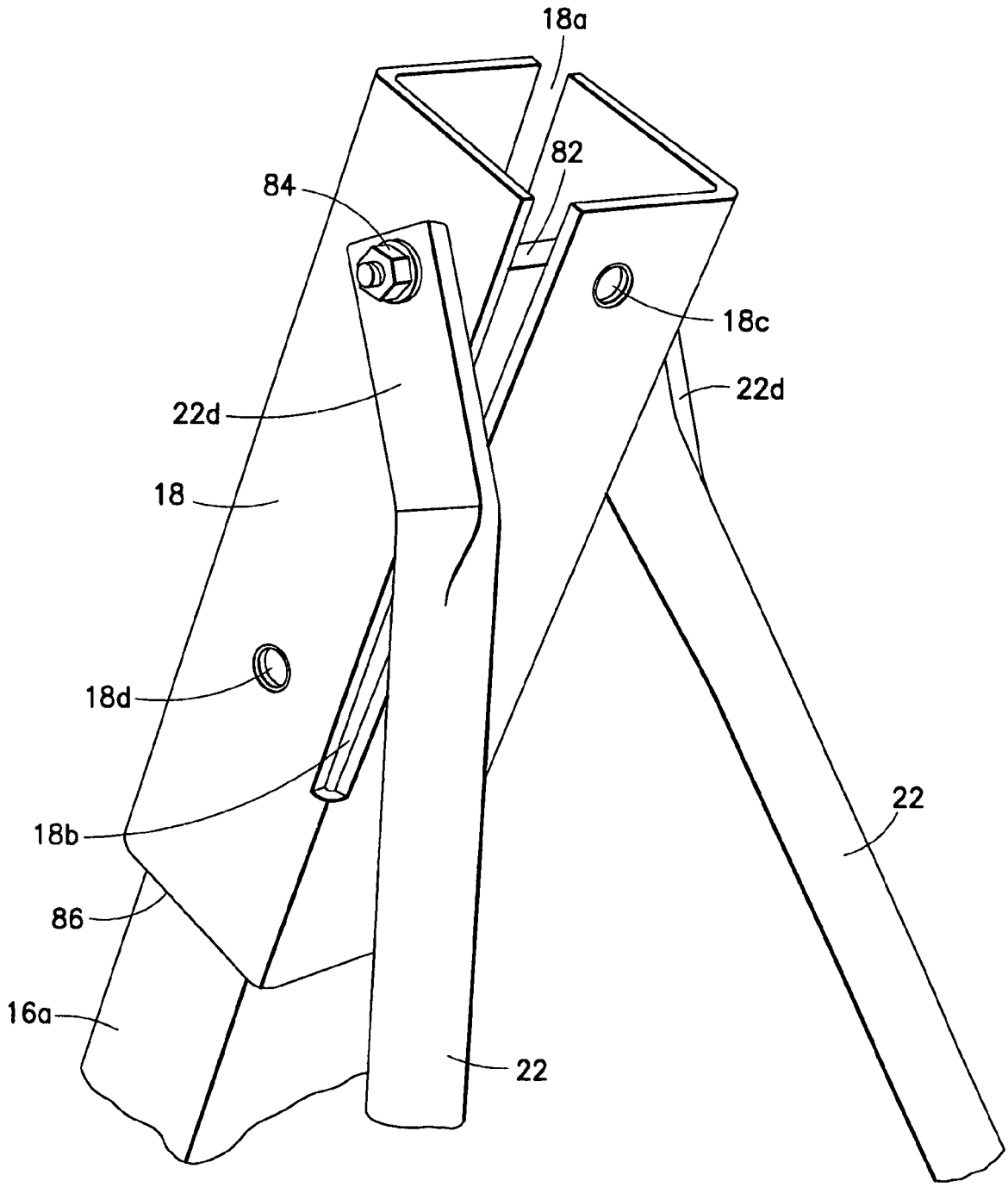
FIG. 5 is an enlarged perspective view of a coupling member, illustrating the details of assembly and connection of the trusses to the primary support member, including its multiple extension portions, to each other.

Referring to FIG. 5, details are shown of coupling member 18 and the manner in which it is connected to the trusses 22, as well as the structure for receiving and connecting to the upper portion 16*b* of the support member. The coupling member 18 is a generally hollow member having a rectangular and/or square cross section consistent with the cross section of the lower portion 16*a*. The lower end of the couple member 18 may be permanently secured to the lower portion 16*a* by any suitable or conventional means, such as a weld 86. The upper end of the coupling member is provided with two diagonally opposed slots 18*a*, 18*b*, at opposing diagonally opposite corners of the coupling member to, in essence, create two right-angle brackets that are fixed at their lower ends but movable at their upper ends in two mutually orthogonal directions. Holes 18*c* are provided for passage of suitable bolts, generally along the plane of symmetry of the boxing center framework, while transverse holes 18*d* are provided for transverse bolts such as bolts 82 secured in place with nuts 84. The coupling 18 can, therefore, receive within the upper open end thereof the lower free end of the mounting portion 16*b* and such latter portion can be clamped in place by adequately tightening the system of bolts so that the portion 16*b* can be clamped to orthogonally related directions, as necessary. The bolt 82, therefore, can both provide a fastening of the flat ends 22*d* of the trusses 22 to the coupling member 18 and secure the upper portion 16*b* of the support member 16 when tightened within the coupling member.

Figure 6:
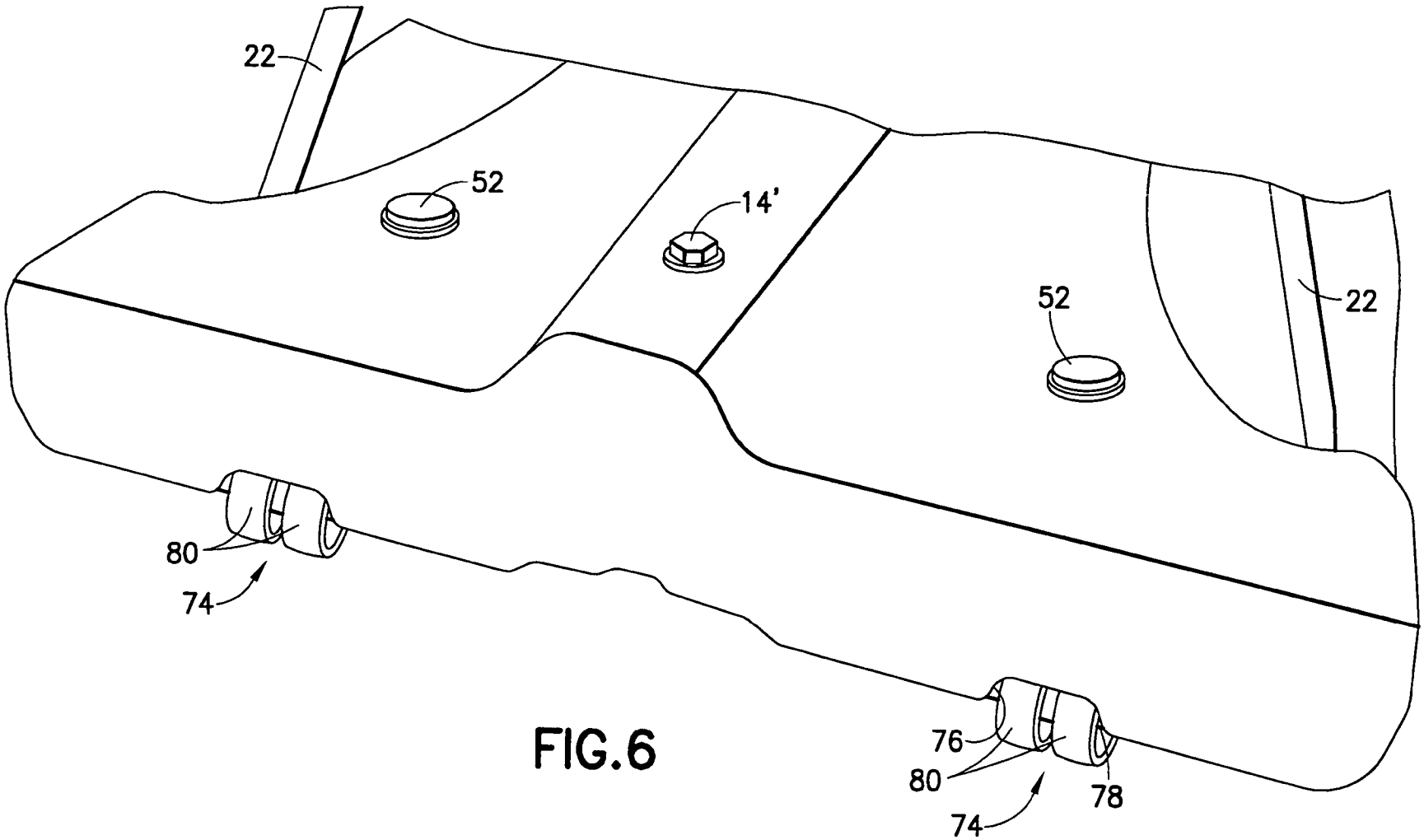
FIG. 6 is a rear perspective elevational view of the base of the boxing center shown in FIGS. 2-5, illustrating the manner in which two sets of rollers or wheels are mounted within recesses or wells in the lower surface of the base.
Figure 7:
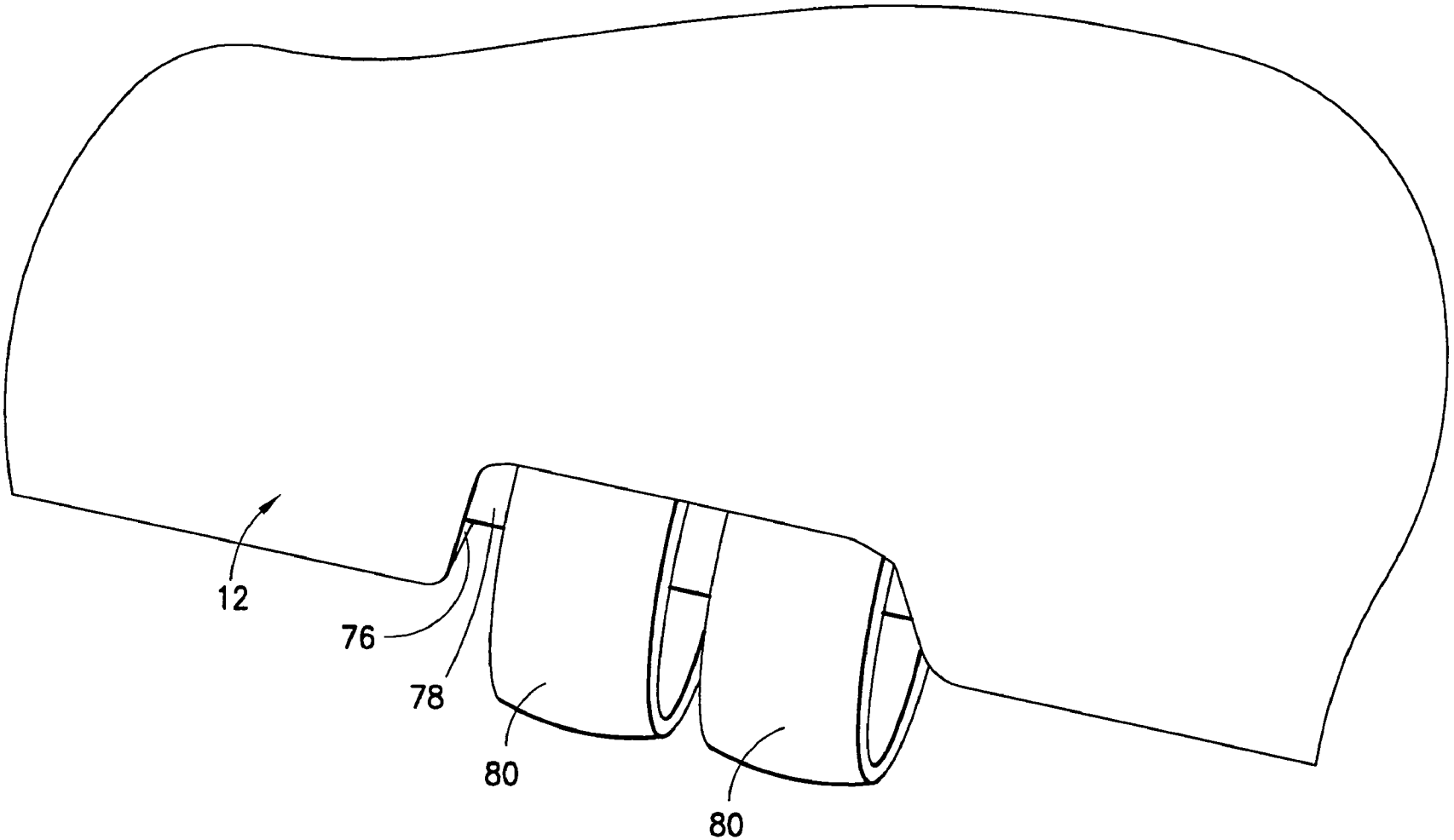
FIG. 7 is an enlarged view of one of the sets of wheels shown in FIG. 6.

Referring to FIGS. 6 and 7, one arrangement is shown for providing mobility to the wide end 12*a* of the base. Thus, recesses or wells 76 on the nether surface of the base, as shown, and wheel assemblies 74 may be mounted within recesses or wells 76 by means of transverse axles 78 on which a pair of wheels 80 is mounted at each side. In the embodiment shown, the axles 78 are fixed in position and are not intended to be raised or lowered relative to the wide end of the base 12*a*. However, clearly, suitable lever means can be provided for raising or lowering the wheels 80 at the wide end of the base as well as at the narrow end of the base, as discussed.

Important aspects or features of the present invention include the use of a heavy punching or kick bag that is typically left in place at the free end 16*d*, as shown. Clearly, because such a heavy bag weighs a significant amount, it is preferably not to mount it and dismantle it regularly. On the other hand, the speed bag 30 is light in weight and can be readily removed. Other bags, drill or exercise bags, can be used that are either just supported at the top or supported at the top and bottom, at 90 in FIG. 1, or to the tab and through the hole 72, as shown in FIG. 4. For this reason, it is presently preferred that the horizontal beam and the pivot assembly 32 be mounted to be generally directly or substantially directly above the connection point 90 or the tab 70 when the handle 54 is retracted in the position shown in FIG. 2. It is preferred that the base be made from plastic or other material that can withstand inclement weather or climatic conditions. The heavy punching bag is preferably also made from water- and weather-resistant materials so that the entire multi-station boxing center can be stationed indoors or outdoors, or, by means of the wheels described, moved at will despite or notwithstanding the heavy weight of the boxing center with the heavy or kick bag 34 attached or suspended, as shown.

It will be clear from the foregoing that the multi-station boxing center in accordance with the present invention can be readily, quickly and conveniently assembled from a plurality of smaller elements or components, that it can be used indoors and/or outdoors and can readily be moved and made mobile to transport the device from one environment to another for use in either.

While this invention has been described in detail with particular reference to preferred embodiments thereof, it will be understood that variations and modifications will be effected within the spirit and scope of the invention as described herein.

What is claimed is:

1. A multi-station boxing center comprising:

a base arranged to be positioned on a generally horizontal support surface, said base being provided with a plurality of generally flat solid webs having a thickness substantially less than the height of said base; a canted frame mounted on said base and secured to said flat webs and having a means for supporting a heavy bag and a means for supporting a speedbag, wherein said canted frame is positioned at an angle with said horizontal support surface such that the effective center of gravity of said boxing center prevents tipping of said boxing center, and wherein said base is disposed to prevent interference with the movements of a user.

2. The multi-station boxing center of claim 1, wherein said boxing center is selectively movable.

3. The multi-station boxing center of claim 1, wherein said base is a molded enclosure that may be filled with a weight bearing material.

4. The multi-station boxing center of claim 3, wherein said weight bearing material is selected from the group consisting of water, sand, and concrete.

5. The multi-station boxing center of claim 3, wherein said base further comprises a removable plug for sealing said enclosure.

6. The multi-station boxing center of claim 1, wherein said canted frame is inclined at an angle of approximately 70 degrees with said horizontal support surface.

7. The multi-station boxing center of claim 1, wherein said canted frame and said base are formed of weather-resistant materials.

8. The multi-station boxing center of claim 1, wherein said canted frame has a primary support member free end that projects beyond a footprint of said base.

9. The multi-station boxing center of claim 1, further comprising a pair of support trusses each of which is secured to one of said flat webs at a lower end thereof and attached to said canted frame at an upper end thereof.

10. The multi-station boxing center of claim 1, wherein the angle of inclination of said canted frame is such that the center of gravity acting through said heavy bag may be adequately compensated for by the center of gravity of said base.

* * * * *